US007530342B2

(12) United States Patent
Surnilla et al.

(10) Patent No.: US 7,530,342 B2
(45) Date of Patent: May 12, 2009

(54) APPROACH FOR FACILITATING FUEL EVAPORATION IN CYLINDER OF AN INTERNAL COMBUSTION ENGINE

(75) Inventors: Gopichandra Surnilla, West Bloomfield, MI (US); Andreas Schamel, Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 447 days.

(21) Appl. No.: 11/470,983

(22) Filed: Sep. 7, 2006

(65) Prior Publication Data

US 2008/0060609 A1 Mar. 13, 2008

(51) Int. Cl.
*F01L 1/34* (2006.01)
*F02B 17/00* (2006.01)

(52) U.S. Cl. ..... 123/299; 123/305

(58) Field of Classification Search ..... 123/299, 123/295, 300, 305, 478, 480
See application file for complete search history.

(56) References Cited

U.S. PATENT DOCUMENTS

| | | | | |
|---|---|---|---|---|
| 4,641,613 | A | 2/1987 | Delesalle | |
| 5,657,730 | A | 8/1997 | Gustavsson | |
| 6,058,905 | A * | 5/2000 | Nagaishi et al. | 123/295 |
| 6,619,241 | B2 | 9/2003 | Otterspeer et al. | |
| 6,647,948 | B2 | 11/2003 | Kyuuma et al. | |
| 6,739,309 | B2 * | 5/2004 | Hiraya et al. | 123/279 |
| 6,988,477 | B2 | 1/2006 | Kataoka et al. | |

* cited by examiner

*Primary Examiner*—Hieu T Vo
(74) *Attorney, Agent, or Firm*—Allan J. Lippa; Alleman Hall McCoy Russell & Tuttle LLP

(57) ABSTRACT

A method of operating an engine including at least one cylinder and a piston disposed within the cylinder, the method comprising during a first condition, injecting fuel into the cylinder and subsequently operating the piston to perform one compression stroke before combusting the injected fuel, and during a second condition, injecting fuel into the cylinder and subsequently operating the piston to perform at least two compression strokes before combusting the injected fuel.

28 Claims, 5 Drawing Sheets

Strokes

| Cylinder | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 1 | I | C | X | C | P | E | I | C | X | C | P | E | I | C | P | E |
| 3 | | I | C | X | C | P | E | I | C | X | C | P | E | I | C | P |
| 4 | | | I | C | X | C | P | E | I | C | X | C | P | E | I | C |
| 2 | | | | I | C | X | C | P | E | I | C | X | C | P | E | I |

FIG. 5A

Strokes

| Cylinder | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 1 | I | C | X | C | P | E | I | C | X | C | P | E | I | C | P | E |
| 3 | | I | C | P | E | I | C | P | E | I | C | P | E | I | C | P |
| 4 | | | I | C | X | C | P | E | I | C | X | C | P | E | I | C |
| 2 | | | | I | C | P | E | I | C | P | E | I | C | P | E | I |

FIG. 5B

Cranking →

Strokes →

| Cylinder | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 1 | I | C | X | C | P | E | I | C | X | C | P | E | I | C | P | E |
| 3 | C | X | C | X | C | P | E | I | C | X | C | P | E | I | C | P |
| 4 | I | C | X | C | X | C | P | E | I | C | X | C | P | E | I | C |
| 2 | C | X | C | X | C | X | C | P | E | I | C | X | C | P | E | I |

FIG. 5C

Strokes →

| Cylinder | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 1 | I | C | P | E | I | C | P | E | I | C | P | E | I | C | P | E |
| 3 | | I | C | X | C | P | E | I | C | X | C | P | E | I | C | P |
| 4 | | | | | | | | | | | | | | | I | C |
| 2 | | | | I | C | X | C | P | E | I | C | X | C | P | E | I |

FIG. 5D

APPROACH FOR FACILITATING FUEL EVAPORATION IN CYLINDER OF AN INTERNAL COMBUSTION ENGINE

BACKGROUND AND SUMMARY

Some internal combustion engines utilize a fuel delivery system that enables direct injection of fuel into one or more cylinders of the engine. Direct injection engines may be operated across a broad range of ambient conditions, including relatively cold temperatures. However, because directly injected fuel receives less heat energy during the intake process, as compared with port injection for example, during cold start or engine warm-up conditions, evaporation of directly-injected fuel into the cylinder may be reduced or may not occur before a combustion event.

In one approach, to address the reduction in evaporation at colder temperatures, an excess amount of fuel may be directly-injected into the cylinder so that the fuel that evaporates provides an air/fuel ratio that is near stoichiometric or other suitable ratio. After combustion, the excess fuel in the cylinder that did not participate in the combustion process may be exhausted during the exhaust stroke as hydrocarbon (HC) emissions. Thus, emissions may be increased and/or fuel efficiency may be decreased during these and other conditions.

In another approach, as described in U.S. Pat. Nos. 4,641,613 and 5,657,730, the fuel supply system may be stopped during an operation where air within the cylinder is compressed over one or more cycles while intake and/or exhaust valves or throttles are closed, thereby increasing the temperature of the air within the cylinder. When the air is heated to a suitable temperature by the compression operation, the injection of fuel can be initiated to cause combustion of the air and fuel mixture.

The inventors herein have recognized a disadvantage with these approaches. Specifically, the heating of the air within the combustion chamber in this manner may provide insufficient evaporation of later injected fuel due to the additional time that may be needed to transfer heat energy from the warmed air to the injected fuel. In other words, the direct injection of fuel after the air within the cylinder is heated may still not provide the desired air/fuel ratio depending on the rate of evaporation. Thus, the above approaches may still use additional fueling of the cylinder to achieve a suitable air/fuel ratio.

In another approach as disclosed herein, the above issues may be addressed by a method of operating an engine including at least one cylinder and a piston disposed within the cylinder, the method comprising during a first condition, injecting fuel into the cylinder and subsequently operating the piston to perform one compression stroke before combusting the injected fuel; and during a second condition, injecting fuel into the cylinder and subsequently operating the piston to perform at least two compression strokes before combusting the injected fuel.

In this manner, evaporation of the fuel within the cylinder may be selectively increased since the fuel may be heated and at least partially evaporated at least during each of the compression strokes. For example, during a compression stroke, the charge temperature and/or enthalpy of the charge rises, which allows the injected fuel to be at least partially evaporated during the first compression. Then, at least some of the evaporated fuel may remain in the evaporated state during the expansion stroke. As compression is performed again, still more evaporation of fuel can be achieved. Depending on the amount of evaporation desired, the number of compressions may be adjusted, thereby achieving improved starting emissions, for example.

Note that while direct injection of fuel may be used in one approach as noted above, other approaches may also be used, and may actually be more advantageous. For example, multiple compression strokes may be used with port injection of fuel, along with open valve injection. Further, more than two compression strokes may also be used to achieve the desired evaporation of fuel, air and fuel mixing, and/or air/fuel ratio.

BRIEF DESCRIPTION OF DRAWINGS

FIGS. 5A-5D show timing tables for an example four cylinder engine, where when the pistons of cylinders 1 and 4 are moving up (toward the cylinder head), the pistons of cylinders 2 and 3 are moving down (away from the cylinder head).

DETAILED DESCRIPTION

Figure 1:
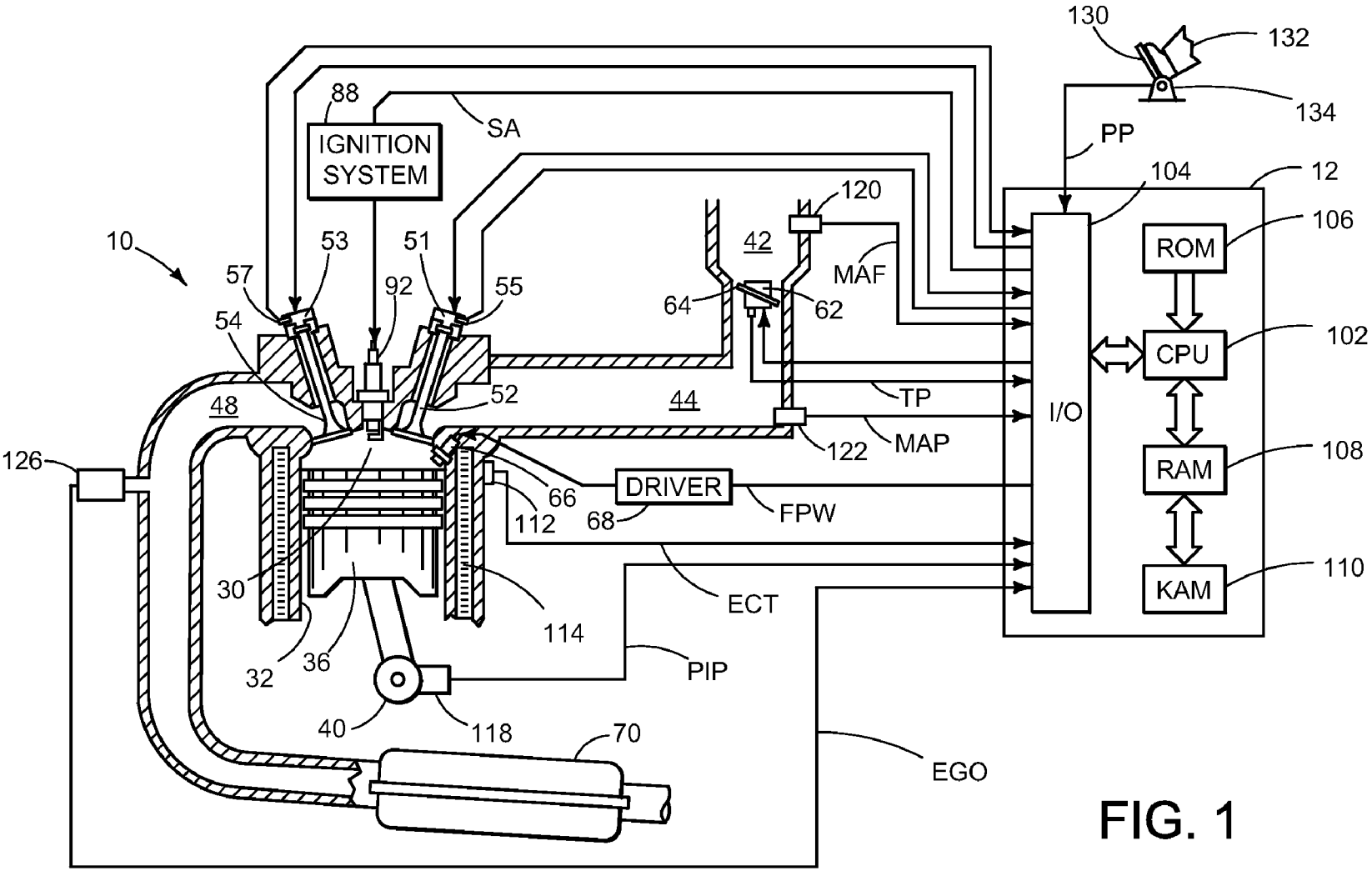
FIG. 1 schematically shows one cylinder of a multi-cylinder engine.

FIG. 1 is a schematic diagram showing one cylinder of multi-cylinder engine 10, which may be included in a propulsion system for a passenger vehicle. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (i.e. cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of the passenger vehicle via a transmission system. Further, a starter motor may be coupled to crankshaft 40 via a flywheel to enable a starting operation of engine 10.

Combustion chamber 30 may receive intake air from intake passage 44 via intake manifold 42 and may exhaust combustion gases via exhaust passage 48. Intake passage 44 and exhaust passage 48 can selectively communicate with combustion chamber 30 via respective intake valve 52 and exhaust valve 54. In some embodiments, combustion chamber 30 may include two or more intake valves and/or two or more exhaust valves.

Intake valve 52 may be controlled by controller 12 via electric valve actuator (EVA) 51. Similarly, exhaust valve 54 may be controlled by controller 12 via EVA 53. During some conditions, controller 12 may vary the signals provided to actuators 51 and 53 to control the opening and closing of the respective intake and exhaust valves. The position of intake valve 52 and exhaust valve 54 may be determined by valve position sensors 55 and 57, respectively. In alternative embodiments, one or more of the intake and exhaust valves may be actuated by one or more cams, and may utilize one or more of cam profile switching (CPS), variable cam timing (VCT), variable valve timing (VVT) and/or variable valve lift (VVL) systems to vary valve operation. For example, cylinder 30 may alternatively include an intake valve controlled via electric valve actuation and an exhaust valve controlled via cam actuation including CPS and/or VCT.

Fuel injector 66 is shown coupled directly to combustion chamber 30 for injecting fuel directly therein in proportion to the pulse width of signal FPW received from controller 12 via electronic driver 68. In this manner, fuel injector 66 provides what is known as direct injection of fuel into combustion chamber 30. The fuel injector may be mounted in the side of the combustion chamber or in the top of the combustion chamber, for example. Fuel may be delivered to fuel injector 66 by a fuel system (not shown) including a fuel tank, a fuel pump, and a fuel rail. In some embodiments, combustion chamber 30 may alternatively or additionally include a fuel injector arranged in intake passage 44 in a configuration that provides what is known as port injection of fuel into the intake port upstream of combustion chamber 30.

In some embodiments, engine 10 may be configured to operate with different fuel types or varying mixtures of one or more fuel types. For example, the fuel provided to a cylinder via a fuel injector may include one or more of gasoline, ethanol, methanol, diesel or other fuel and/or water. In some embodiments, one or more cylinders of the engine may be configured to operate in a spark ignition mode, homogeneous charge compression ignition (HCCI) mode, and/or a diesel compression ignition mode and may be configured to transition between two or more of these modes.

Intake manifold 42 may include a throttle 62 having a throttle plate 64. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP. Intake manifold 42 may include a mass air flow sensor 120 and/or a manifold air pressure sensor 122 for providing respective signals MAF and MAP to controller 12.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Exhaust gas sensor 126 is shown coupled to exhaust passage 48 upstream of emission control device 70. Sensor 76 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Emission control device 70 is shown arranged along exhaust passage 48 downstream of exhaust gas sensor 126. Device 70 may be a three way catalyst (TWC), NOx trap, various other emission control devices, or combinations thereof. In some embodiments, during operation of engine 10, emission control device 70 may be periodically reset by operating at least one cylinder of the engine within a particular air/fuel ratio.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft.

As described herein, a mixture of air and fuel within a combustion chamber of the engine may be controlled to be lean of stoichiometry, rich of stoichiometry, near stoichiometry, or at stoichiometry. A mixture that is lean of stoichiometry may include less fuel than a stoichiometric amount of fuel for the air charge of the cylinder. Similarly, a mixture that is rich of stoichiometry may include more fuel than a stoichiometric amount of fuel for the air charge of the cylinder. During operation in some combustion modes such as where spark ignition of the mixture is employed to achieve combustion, the mixtures combusted in the cylinder may be varied between rich of stoichiometry, at stoichiometry, near stoichiometry, and at stoichiometry in response to operating conditions of the engine. During operation in other combustion modes where autoignition of the mixture is achieved without necessarily requiring an ignition spark, such as during operation in a homogeneous charge compression ignition mode, the mixture may be controlled to be lean of stoichiometry to increase fuel efficiency and reduce NOx and/or hydrocarbons in the exhaust gas produced by the engine.

As described above, FIG. 1 shows only one cylinder of a multi-cylinder engine, and that each cylinder may similarly include its own set of intake/exhaust valves, fuel injector, spark plug, etc. Engine 10 may be configured to operate as a four-stroke engine during some conditions. During other conditions, engine 10 may increase or decrease the number of strokes performed per combustion event for one or more cylinders of the engine. For example, during some conditions, the engine may use a multi-stroking approach, wherein an air and fuel charge are compressed through two or more compression strokes prior to combustion is initiated to improve evaporation of the fuel and/or mixing of the air and fuel.

Figure 2:
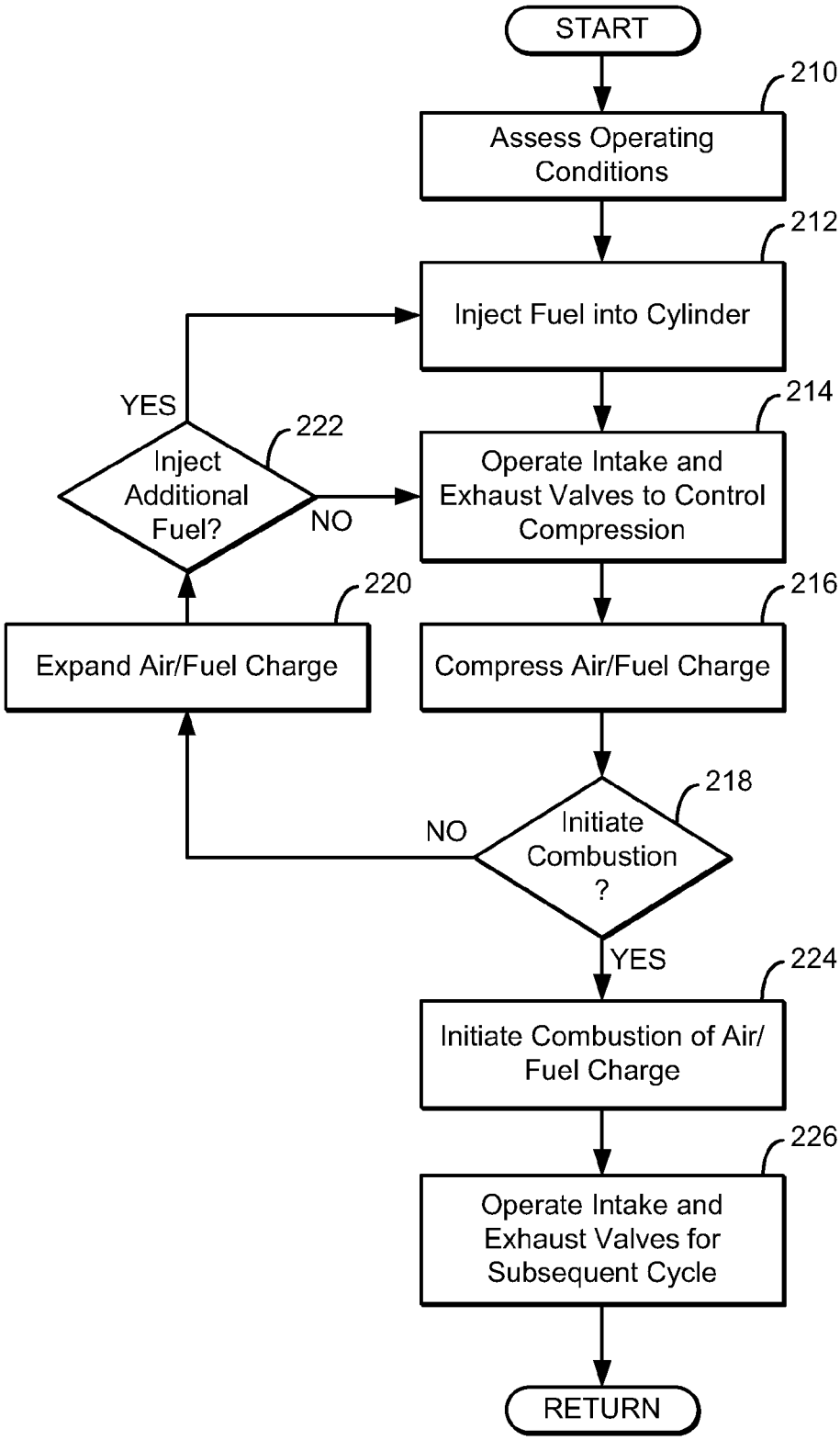
FIG. 2 shows a flow chart describing an example control routine.

FIG. 2 describes a non-limiting example approach that may be used to increase evaporation of fuel within a cylinder of the engine and/or to improve the mixing of the fuel with air prior to combustion. At 210, the control system may assess the operating conditions of the engine, including past, present and/or future predicted operating conditions. Operating conditions may include ambient conditions such as air temperature, air pressure, humidity, engine torque, engine speed, number of combustion events after start-up, number of strokes or cycles after start-up, time after start-up, period of engine start-up including cranking, engagement condition of a starter motor, engine temperature, fuel type, fuel volatility, fuel temperature, quantity of fuel injected, number of cylinders of the engine, number of active cylinders of the engine, turbocharging or supercharging conditions, exhaust after-treatment device conditions, intake and exhaust valve position, throttle position, noise and vibration harshness (NVH), among others and combinations thereof.

In some embodiments, before and/or after the operating conditions are assessed, the control system may select at least an initial combustion strategy for the subsequent cycle. As one example, the control system may initially select a multi-stroking operation where two or more compression strokes are performed per the next combustion event based on an assessment of the operating conditions. Further, the control system may initially select a number of compression strokes and corresponding expansion strokes that may be performed, the amount of fuel that is to be delivered to the cylinder and/or the number of fuel injections that may be performed prior to the next combustion event (i.e. within the next cycle). For example, the amount of fuel that is injected and/or the number of injections may be varied to increase and/or decrease as the number of compression strokes performed per cycle is varied.

For example, if the temperature of the engine is less than a threshold, the control system may select an operating mode where two or more compression strokes are used to compress an air and fuel charge to improve evaporation of the fuel prior to initiating combustion. The control system may also select the number of fuel injections and/or the quantity of fuel injected based on the operating conditions.

At 212, fuel may be injected into the cylinder, for example, by a direct injector. The amount of fuel injected at 214 may depend on the initial combustion strategy selected above. For example, only a portion of the total fuel charge may be injected at 212 if multiple fuel injections are to be performed during the cycle. Further, the amount of fuel that is injected may be varied in response to the desired number of compression strokes performed on the fuel charge prior to initiating combustion. At 214, the intake and exhaust valves may be operated in response to the compression stroke performed at 216 to achieve the desired compression of the air and fuel charge. For example, if a greater increase in fuel evaporation is desired, which may be facilitated by an increase in charge temperature and/or enthalpy due to compression of the charge, then the intake and/or exhaust valves may be held closed or may be substantially closed during the entire compression stroke or at least a portion of the compression stroke. Alternatively, if less evaporation of fuel is desired, or if less compression of the charge is desired, then the intake and/or exhaust valves may be at least partially opened during at least some of the compression stroke.

In other words, the timing of the opening and closing of the intake valves and/or exhaust valves may be varied at 214 to vary the compression provided to the charge during the compression stroke at 216. Alternatively or in addition, the position (e.g. opened, closed, or partially opened) of the intake and/or exhaust valves during the compression stroke may be varied at 214 to vary the compression provided to the charge during the compression stroke at 216. In this manner, the compression provided to the charge may be adjusted to achieve the desired fuel evaporation, peak cylinder pressure, peak cylinder temperature, etc.

At 218, the control system may judge whether to initiate combustion at 218. If the control system has initially selected to perform a multi-compression stroke cycle in response to the assessed operating conditions, then the answer at 218 may be judged no. Alternatively, if the control system has initially selected to perform a single compression stroke, but one or more of the operating conditions during the compression operation have changed, then the answer at 218 may be judged yes.

If the answer at 218 is no, then at 220 the piston can expand the air and fuel charge during the subsequent stroke without combustion being initiated. At 222, it may be judged whether to perform an additional fuel injection. If the control system has initially selected a single injection strategy or selected a multiple fuel injection strategy, but one or more of the operating conditions have changed, then the answer at 222 may be judged no. Alternatively, if the control system initially selected a multiple injection strategy or selected a single injection strategy, but one or more of the operating condition have changed, then the answer at 222 may be judged yes.

If the answer at 222 yes, an additional or supplemental fuel injection may be performed at 212 via a direct injection, for example. Alternatively, if the engine includes both a port injector and a direct injector, at least a portion of the fuel may be injected by the port injector (e.g. during a first fueling operation) and a supplemental portion of the fuel may be injected by the direct injector (e.g. after a first compression of the air and port injected fuel). In some embodiments, the injection may be initiated at least partially during the expansion stroke performed at 220 and/or during the subsequent compression stroke. Alternatively, if the answer at 222 is no, a second compression stroke may be performed and the intake and/or exhaust valves may be operated to achieve the desired compression of the air and fuel charge at 216 and 214, respectively.

Returning to 218, if the answer is instead judged yes, then combustion of the air and fuel charge may be initiated at 224. In one approach, combustion may be initiated via spark ignition, for example, by initiating a spark from a spark plug. Alternatively, if the cylinder is operating in a compression ignition combustion mode (e.g. HCCI or diesel cycle), then a spark may not necessarily be performed and ignition may be initiated by a subsequent fuel injection or by controlling the peak cylinder pressure and/or temperature via valve operation. For example, a diesel cycle may be performed by utilizing one or more initial injections of fuel that are compressed via two or more compression strokes and then subsequently combusted by the addition of a final fuel injection.

As another example, a homogeneous charge compression ignition cycle may be performed by utilizing one or more initial injections of fuel that are compressed via two or more compression strokes while peak cylinder pressure and/or temperature is maintained below conditions where autoignition occurs until ignition of the charge is desired. When ignition is desired, the valves may be controlled during the final compression stroke so that the cylinder pressure and/or temperature attain conditions where autoignition of the fuel charge occurs such as around top dead center. In some embodiments, the engine or a portion of the cylinders thereof may be operated during start-up of the engine or during a cold engine condition in a homogeneous charge compression ignition mode where autoignition of the at least twice compressed mixture is used to achieve combustion. For example, the engine or a portion of the cylinders may be started under a cold engine condition in HCCI mode by compressing the air charge and/or at least a portion of the fuel within the cylinder multiple times to create a temperature increase of the air charge. Autoignition may be controlled to occur by varying valve operation during the successive compression and expansion strokes to control charge temperature and pressure, and/or by varying a timing of a final injection of fuel. One advantage of starting in HCCI mode with a substantially homogeneous mixture of air and fuel may include lower levels of NOx and hydrocarbons in the exhaust gas during cold start where the catalyst temperature is below a warmed-up operating temperature.

At 226, the intake and/or exhaust valves may be operated to prepare the cylinder for the subsequent cycle, including exhausting of exhaust gases from the cylinder and inducting intake air into the cylinder. Finally, the routine may return to 210 for the subsequent cycle. In this manner, one or more compression strokes may be used to achieve the desired charge heating, charge mixing and/or evaporation of the fuel within the cylinder.

As described above with reference to FIG. 2, two or more compression strokes may be performed on a fuel charge per combustion event to facilitate fuel evaporation during different operating conditions. The following scenarios provide non-limiting examples of how the number of compression strokes may be varied in response to some of these operating conditions. It should be appreciated that the following examples, in some cases, may be combined to provide improved fuel evaporation during conditions where two or more of these operating conditions are varying.

As a first example scenario, the number of compression strokes performed on an air and fuel charge may be varied in response to the temperature of the engine and/or temperature of the intake air provide to the cylinder. For example, when the engine is started from a cold condition, one or more of the cylinders may perform two or more compression strokes per combustion event to facilitate fuel evaporation. As the temperature of the engine increases, the number of compression strokes performed per combustion event may decrease. As another example, an engine that is started during a first temperature condition (e.g. a warm start or restart) may utilize fewer compression strokes per cycle than a second colder temperature condition (e.g. cold start), for at least one or more cycles after start-up. In yet another example, the number of cylinders that are utilizing multiple compression strokes per cycle may be varied with engine temperature.

As a second example scenario, the number of compression strokes performed per cycle may be varied in response to one or more fuel conditions including the fuel volatility, fuel energy density, fuel type, fuel blend (e.g. gasoline and ethanol), fuel temperature, quantity of fuel injection, etc. For example, an engine utilizing a first fuel type including at least ethanol or methanol may utilize a greater number of compression strokes per cycle than if the engine was utilizing a second fuel type including at least gasoline. In this manner, the multi-stroking of one or more cylinders of the engine may be varied in response to fuel conditions to provide the desired evaporation of the fuel.

In some embodiments, some of these fuel conditions may be determined by one or more approaches. In one approach, a fuel sensor located in the fuel system (e.g. in the gas tank) may be used to provide a measurement of fuel conditions such as fuel temperature or fuel type including relative proportion of two or more fuels of a mixture (e.g. E85 which includes approximately 85% ethanol and 15% gasoline). In another approach, an oxygen sensor or other exhaust gas sensor may be used to determine a fuel condition from a shift in the detected air/fuel ratio from a known or learned value. In yet another approach, a fuel condition such as fuel volatility, fuel quality, fuel type, and/or proportion of two or more fuel types of a mixture may be learned from an output (e.g. rpm, torque, etc.) of the engine during a starting event. For example, the control system may learn a condition of the fuel during a first start event based on how the engine rpm varies during the start-up. During a subsequent start, the learned fuel condition can be used to improve engine starting, for example, by varying the amount of fuel injected and/or varying the number of compression strokes performed on the injected fuel per cycle.

As a third example scenario, the number of compression strokes performed per cycle may be varied in response to a condition relative to engine start-up including time after start, number of cycles or strokes after start-up, stage of start-up such as during cranking or warm-up, and/or during a condition where a starter motor is engaged with the engine. For example, the number of compression strokes performed per cycle and/or the number of cylinders that are multi-stroking may be varied based on whether the starter motor is engaged with the engine. As yet another example, the number of compression strokes performed per cycle may be decreased with time after start-up or may be varied between a cranking period and a warm-up period, and a warmed period. Further, one or more single compression stroke cycles may be used during cranking to achieve sustainable rotation of the engine followed by one or more cycles having two or more compression strokes to achieve warm-up of the engine while reducing the amount of fuel supplied to the cylinder, thereby reducing hydrocarbon emissions. As the engine begins to increase in the temperature, the number of combustion strokes performed per cycle may be reduced until a single compression stroke is performed per cycle. Another example scenario may include the use of one or more cycles each having multiple compression strokes during cranking and/or start-up followed by a gradual reduction in the number of compression strokes per cycle until a four-stroke cycle is attained.

As a fourth example, the number of compression strokes performed per cycle of a particular cylinder may be varied in response to a condition of the other cylinders. For example, the number of compression strokes performed by a particular cylinder may be increased or decreased based on the number of compression strokes performed by one or more other cylinders of the engine. As another example, the number of compression strokes performed by particular cylinder may be varied in response to the combustion mode of the cylinder (e.g. spark ignition, homogeneous charge compression ignition, diesel compression ignition, etc.). As yet another example, the number of compression strokes performed by a particular cylinder may be varied in response to the number of active or deactivated cylinders.

Figure 3:
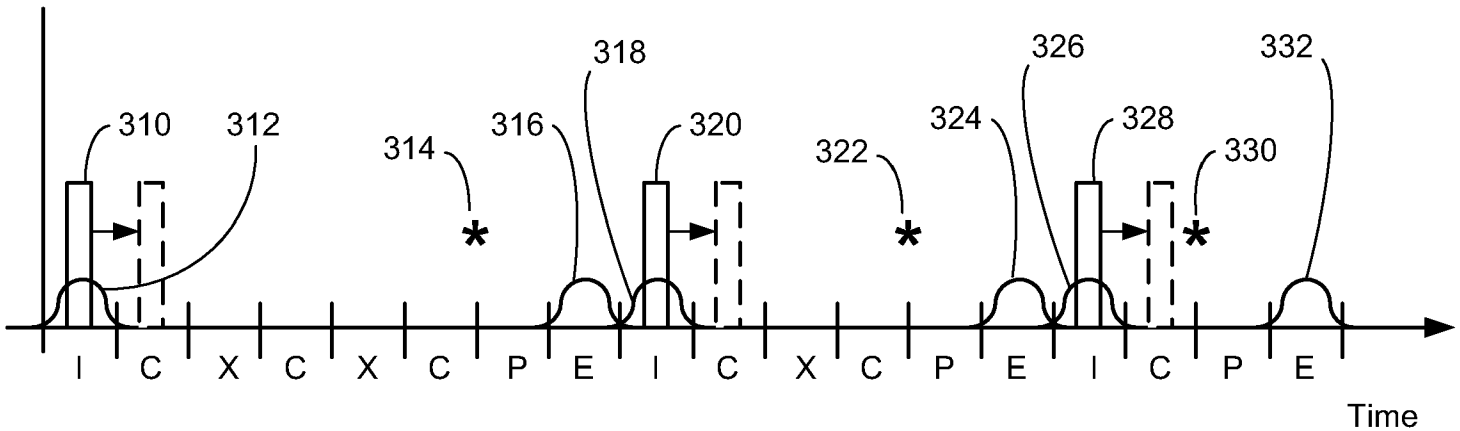
FIGS. 3 and 4 show timing diagrams of example multi-stroking scenarios.

FIG. 3 is a timing diagram showing a non-limiting example of the approach described above with reference to FIG. 2. The horizontal axis of the diagram represents time. Specifically, the labels intake (I), compression (C), expansion (X) (i.e. does not include combustion) or power (P) (i.e. includes combustion), and exhaust (E) strokes are shown for convenience.

Beginning on the left side of the diagram with the first intake stroke, one or more intake valves are operated at 312 to admit intake air (and/or fuel if a port injection system is used) into the cylinder. At 310 an injection of fuel is performed directly into the cylinder. The injection of fuel may occur during the intake and/or compression strokes as indicated by the alternative injection timing shown by a broken line. The air and fuel charge within the cylinder may be compressed during the compression stroke to facilitate evaporation of the fuel and air while the intake and exhaust valves are held substantially closed during part or all of the stroke. In this example, two subsequent compression strokes are performed to facilitate additional evaporation of fuel before an ignition is achieved (e.g. via an ignition spark or autoignition) at 314 followed by combustion of the air and fuel during the power stroke.

The exhaust valves and intake valves may be respectively operated at 316 and 318 during the subsequent exhaust and intake strokes to enable exhausting of the exhaust gases from the previous combustion event and the admission of intake air for the next combustion event. At 320, fueling of the cylinder may be again performed by injecting fuel directly into the cylinder. In this example, two compression strokes are performed to facilitate evaporation before an ignition is achieved at 322 to initiate combustion of the air and fuel mixture.

The exhaust valves and intake valves may be respectively operated at 324 and 326 during the subsequent exhaust and intake strokes to enable exhausting of the exhaust gases from the previous combustion event and the admission of intake air for the next combustion event. At 328, fuel may be again injected into the cylinder by the direct injector. In this example, a single compression stroke is performed before an ignition is achieved at 330 to initiate combustion of the air and fuel mixture, followed by subsequent operation of the exhaust valves at 332.

The example multi-stroking operation shown in FIG. 3 may be used, for example, during start-up, wherein the number of compression strokes performed per cycle is gradually decreased as the cylinder and/or engine is warmed. For example, a cylinder may utilize three compression strokes per cycle for one or more cycles to compress at least a portion of the fuel charge followed by one or more cycles utilizing two compression strokes, until a single compression stroke per cycle may be performed as the engine is returned to a four-stroke operating mode. In some embodiments, 1, 2, 3, 4, 5, 6 or more compression strokes may be performed by a cylinder per combustion event.

Figure 4:
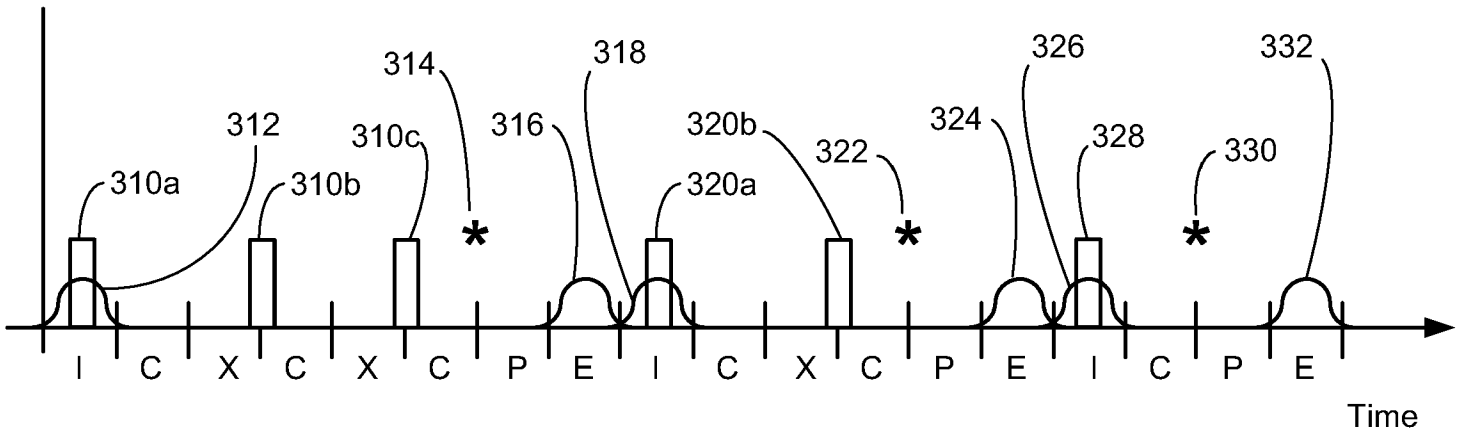

While FIG. 3 shows an example where a single fuel injection may be performed per cycle, in some embodiments, multiple injections of fuel may be performed during a multi-stroking operation. FIG. 4 shows the example scenario of FIG. 3 including the use of multiple fuel injections. For example, injections 310*a*, 310*b*, and 310*c* may be performed during some or each of the compression strokes. In this example, the control system may select a number of compression strokes that may be performed for a particular combustion event based on operating conditions of the engine. The total amount of fuel injected for the combustion event may be achieved by utilizing a plurality of smaller injections. For example, injections 310*a*, 310*b*, and 310*c* may be performed prior to the initiation of a spark or autoignition is achieved. Further, each compression stroke may include a plurality of fuel injections. For example, injection 310*a* may be split into two or more injections.

During subsequent engine events, a lower or greater quantity of injections may be performed based on the number of compression strokes performed per combustion event. For example, injections 320*a* and 320*b* may be performed over each of the compression strokes, thereby splitting the single injection shown at 320 in FIG. 3 into two or more injections. Finally, when a single compression stroke is performed, a single fueling operation including one or more injections may be performed at 328. In this manner, a first portion of the fuel may be injected and compressed and a second portion of the fuel may be injected and compressed during a subsequent stroke in addition to the first portion of fuel.

While the examples provided by FIGS. 3 and 4 show number of compression strokes per combustion event decreasing with each subsequent combustion event, it should be appreciated that during some conditions, the number of compression strokes may remain constant, may increase, or may decrease with each subsequent combustion event as desired for each cylinder.

The multi-stroking approaches for facilitating the evaporation of fuel within the combustion chamber as described herein may be applied to one or more cylinders of the engine. In some embodiments, each of the engine cylinders may utilize two or more compression strokes per combustion event, at least during some conditions. In some embodiments, only a portion of the cylinders of the engine may utilize two or more compression strokes per combustion event during some conditions, while the other portion of the cylinders may utilize only one compression stroke per combustion event.

As one example, noise and vibration harshness (NVH) may be controlled and/or reduced by varying the number of cylinders that are operating with two or more compression strokes per combustion event. For example, if an undesirable or unsuitable level of NVH occurs at a particular cylinder/multi-stroking mode, then these modes may be avoided or the time of operation in these modes may be reduced. If, for example, an undesirably high level of NVH is produced during scenarios where all of the cylinders are operated with two or more compression strokes per combustion event, then one or more of the cylinders may increase or decrease the number of compression strokes that are performed per combustion event. In this manner, the combustion events may be scheduled to occur at times where a sufficiently low level of NVH may be achieved.

FIGS. 5A, 5B, 5C, and 5D show timing tables describing example multi-stroking scenarios that may be performed with an engine having four cylinders arranged in an in-line configuration; however, it should be appreciated that the examples of FIG. 5 are non-limiting and that the approaches described herein may be applied to other engine types and configurations. In each of the tables, cylinder identifiers 1-4, are used to describe the physical order of the cylinders in the engine having an in-line configuration; however other orders are possible. The cylinder identifiers represented on the vertical axis are arranged based on the firing order of the cylinders during a four-stroke operation. Thus, the firing order during at least the four-stroke operation includes cylinder 1, followed by cylinder 3, followed by cylinder 4, followed by cylinder 2, wherein the order may be repeated. In this example, the cylinders are phased 180 crank angel degrees apart for a total four-stroke cycle duration of 720 degrees. Thus, when the pistons of cylinders 1 and 4 are moving toward top dead center, the pistons of cylinders 3 and 2 are moving toward bottom dead center.

The horizontal axis of the tables shown in FIGS. 5A-5D represents the number of strokes performed by each cylinder from a reference time. As will be described in greater detail, the reference time may include engine start-up, engine cranking, or other suitable event. The stroke type is represented in the tables as intake (I), compression (C), expansion (X) (i.e. does not include combustion) or power (P) (i.e. includes combustion), and exhaust (E). During a four-stroke operation, the cycle includes an intake stroke, a compression stroke, an expansion stroke, and an exhaust stroke. During multi-stroking operations, a cycle may include at least two or more compression strokes, wherein each compression stroke may be followed by one of an expansion stroke or a power stroke. For each of the examples shown in FIGS. 5A-5D, the start of a cycle is defined by the beginning of the intake stroke and the cycle is completed at the end of the exhaust stroke.

In the example shown in FIG. 5A, each of the cylinders are operated through the same number of multi-stroke cycles before being transitioned to a four-stroke cycle. For example, cylinder 1 is shown initially operating in an intake stroke at stroke 1, wherein cylinder 1 is subsequently operated in a multi-stroke mode where at least a portion of the fuel is injected into the cylinder and compressed at stroke 2, subsequently expanded and again compressed prior to being combusted during the power stroke at stroke 5. The combusted fuel and air may be subsequently exhausted at stroke 6. Strokes 1-6 may be repeated beginning at stroke 7 and continuing through stroke 12, for example, to achieve increased fuel evaporation. Thereafter, cylinder 1 is shown transitioning at stroke 13 to a four-stroke mode where only a single compression stroke is performed per cycle.

Similarly, cylinders 3, 4, and 2 may be sequentially operated (e.g. 180 degrees or one stroke apart) to perform the same multi-stroking operation including the same number of compression strokes per cycle as cylinder 1. In this manner, each cylinder of the engine may be operated to achieve improved evaporation of the fuel charge while maintaining a sequential combustion phasing such that each of the cylinders may be sequentially transitioned from the multi-stroking operation to the four-stroke operation at a desired time (e.g. beginning at stroke 13 with the intake stroke performed by cylinder 1 followed by cylinder 3 at stroke 14, cylinder 4 at stork 15 and cylinder 2 at stroke 16).

FIG. 5B shows an example where a portion of the cylinders (e.g. cylinders 3 and 2) are operated in a four-stroke mode (i.e. one compression stroke per cycle) while the remaining cylinders (e.g. cylinders 1 and 4) are operated in a multi-stroke mode before being transitioned to a four-stroke mode. For example, cylinder 1 is shown initially operating in an intake stroke at stroke 1, wherein at least a portion of the fuel may be injected into the cylinder where it is compressed, expanded, compressed, and ignited to achieve a power stroke, and finally exhausted. This may be repeated over one or more cycles (e.g. between strokes 7 and 12) and include more compression strokes if desired. Similarly, cylinder 4 may be operated to perform the same number of multi-stroke cycles as cylinder 1, except at a different phasing. Alternatively, cylinder 4 may perform a different number of compression strokes than cylinder 1. Meanwhile, cylinders 3 and 2 may be operated in a four-stroke mode, where a single compression stroke is performed per cycle. Thus, during at least some conditions, some of the cylinders may be operated with a different number of strokes than other cylinders. At a later time, each of the cylinders may transition to a four-stroke mode such that the desired combustion phasing is maintained. For example, beginning at stroke 12 for cylinder 2, each of the cylinders are sequentially operated in a four-stroke mode phased 180 degrees apart from each of the preceding cylinders of the firing order.

Further, the number of strokes per cycle performed by one or more of the cylinders may be varied based on the number of strokes performed by other cylinders to reduce NVH and provide the desired combustion phasing, load balancing, and improved fuel evaporation.

FIGS. 5A and 5B show some of the cylinders initially operating during some conditions without a defined stroke. For example, the tables shown in FIGS. 5A and 5B do not include a particular stroke description for cylinder 2 during strokes 1, 2, and 3. As During this condition, the valves of these cylinders may be held at least partially open or may be held closed to vary the torque required to rotate the engine, for example, during engine start-up or other condition. As one example, one or more of the intake valves and one or more of the exhaust valves may be held open enabling air to flow through the cylinder. Alternatively, all of the intake strokes and/or all of the exhaust strokes may be held closed to prevent air from flowing through the cylinder. Alternatively, as shown in FIG. 5C, these strokes may be used as compression strokes to further improve fuel evaporation.

FIG. 5C shows an example of how the cylinders may be operated during a start-up condition from a cranking period of strokes 1-4. In this example, during the cranking period, at least a portion of the fuel may be injected into one or more of the cylinders during a common stroke where it is compressed at least twice before combusting. For example, at least a portion of the fuel for cylinder 1 may be injected into cylinder 1 during stroke 1 and at least a portion of the fuel for cylinder 4 be injected into cylinder 4. The fuel injected into cylinder 4 may compressed via a first number of compression strokes (e.g. two compression strokes during cranking), before performing a first power stroke, while cylinder 4 may perform a different number of compression strokes (e.g. 3 compression strokes) of at least a portion of the injected fuel before performing a power stroke. In this manner, evaporation of the fuel may be increased while the cylinders are queued for the subsequent power stroke.

Over the subsequent strokes, the number of compression strokes performed per cycle by each cylinder may be varied until a four-stroke mode is achieved by each or a portion of the cylinders. For example, cylinder 1 at stroke 13 is transitioned to a four-stroke cycle, subsequently followed by cylinders 3, 4, and 2. Thus, the number of compression strokes per cycle for each cylinder may be controlled to achieve the desired combustion phasing and fuel evaporation.

FIG. 5D shows an example where some cylinders may be operated in a four-stroke mode, some cylinders may be operated in a multi-stroke or multiple compression stroke mode, and some cylinders may be deactivated for one or more cycles. For example, cylinder 1 is shown operating in a four-stroke mode during strokes 1-16. Cylinders 3 and 2 are shown operating in a multi-stroke mode where two compression strokes are performed per cycle for two cycles. Cylinder 4 is shown operating in a deactivated mode during strokes 1-14. During the deactivated mode, the valves of the cylinder may be held closed (e.g. to cause compression and expansion of an air charge) or one or more of the intake and exhaust valves may be held open to reduce the compression work provided to the cylinder. At a later time, one or more of the cylinders may vary the number of strokes performed per cycle to initiate four-stroke operation and the desired combustion phasing. For example, cylinders 3 and 2 are transitioned to a four-stroke mode at stroke 14 and 16, respectively, while cylinder 4 is activated in a four-stroke mode at stroke 15. In this manner, an engine may be started or operated with only some of the cylinders carrying out combustion, wherein at a later time, for example, when the engine is warmed by the active cylinders, the deactivated cylinders may initiate combustion without necessarily performing multiple compression strokes to facilitate evaporation of the fuel. While the examples of FIGS. 5A-5D show only 16 strokes, it should be appreciated that multi-stroking of one or more cylinder may be performed for greater than 16 strokes or over more than one, two, or three cycles as shown in the above examples.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various steps, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated steps or functions may be repeatedly performed depending on the particular strategy being used. Further, the example routines may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method of operating an engine including at least one cylinder and a piston disposed within the cylinder, the method comprising:

during a first condition, injecting fuel into the cylinder and subsequently operating the piston to perform one compression stroke before combusting the injected fuel; and during a second condition, injecting fuel into the cylinder and subsequently operating the piston to perform at least two compression strokes before combusting the injected fuel.

2. The method of claim 1 further comprising, during at least said second condition, holding at least one intake valve and at least one exhaust valve of the cylinder in a substantially closed position during said at least two compression strokes.

3. The method of claim 1, wherein the first condition includes a first type of fuel and the second condition includes a second type of fuel different than the first type of fuel.

4. The method of claim 3, wherein the first type of fuel includes at least a first fraction of gasoline and the second type of fuel includes at least a second fraction of ethanol.

5. The method of claim 1, wherein said first condition includes a first fuel volatility and the second condition includes a second fuel volatility less than said first fuel volatility.

6. The method of claim 5, wherein at least one of the first and the second fuel volatility are learned from a previous engine start.

7. The method of claim 1, wherein the first condition includes a first engine temperature and the second condition includes a second engine temperature less than said first engine temperature.

8. The method of claim 1, wherein the second condition is during a first number of cycles after a cold start of the engine and the first condition is after said second condition.

9. The method of claim 1, wherein the first condition is during a first number of cycles after a start from a partially heated engine condition and the second condition is during a second number of cycles after a start from a cooler engine condition than said first condition.

10. The method of claim 1 further comprising, during at least the second condition, injecting a first portion of the fuel into the cylinder before completion of the first compression stroke and injecting a second portion of the fuel into the cylinder after the completion of the first compression stroke and before the completion of the second compression stroke.

11. The method of claim 1 further comprising, during a third condition, injecting fuel into the cylinder and subsequently operating the piston to perform at least three compression strokes before combusting the injected fuel.

12. The method of claim 1, wherein the second condition includes a second fuel and the first condition includes a first fuel having greater volatility than said second fuel.

13. The method of claim 1, wherein the fuel is directly injected into the cylinder by a fuel injector coupled at least partially within the cylinder.

14. The method of claim 1 further comprising, during the second condition, varying a timing of the fuel injection based on the number of compression strokes performed by the piston.

15. The method of claim 1 further comprising, during the second condition, varying a number of compression strokes performed by the piston in response to a timing of the fuel injection.

16. A method of operating an engine having at least a first cylinder including a first piston and a second cylinder including a second piston, the method comprising:

injecting fuel into the first cylinder and subsequently operating the first piston to perform a first number of compression strokes before combusting the fuel within the first cylinder; and injecting fuel into the second cylinder and subsequently operating the second piston to perform a second number of compression strokes before combusting the fuel within the second cylinder.

17. The method of claim 16, wherein the first number of compression strokes is varied in response to the second number of compression strokes.

18. The method of claim 16, wherein at least one of the first number of compression strokes and the second number of compression strokes are varied in response to at least one of engine temperature and a number of combustion events after an engine start.

19. The method of claim 16, wherein the first number of compression strokes is less than the second number of compression strokes.

20. The method of claim 19, wherein the fuel is injected into the first cylinder and the second cylinder during a common stroke.

21. The method of claim 16, wherein the second number of compression strokes is at least two and the first number of compression strokes is one during a number of cycles after an engine start.

22. A method of operating an internal combustion engine including at least one cylinder having at least one intake valve and one exhaust valve, comprising:

injecting fuel directly into the cylinder;

compressing a mixture of at least air and fuel during a first compression stroke;

compressing at least the mixture during at least a second compression stroke; and initiating ignition within the cylinder of the mixture that was at least twice compressed.

23. The method of claim 22 further comprising, substantially closing the intake and exhaust valves during at least a substantial portion of the first and the second compression strokes and reducing the number of compression strokes performed over subsequent combustion events after an engine start-up.

24. The method of claim 22, wherein said initiating ignition includes achieving autoignition of the at least twice compressed mixture.

25. The method of claim 24, wherein the twice compressed mixture is substantially homogeneous and includes a ratio of air and fuel that is lean of stoichiometry.

26. The method of claim 24, wherein autoignition is achieved during at least one of a start-up of the engine and a cold condition of the engine.

27. A method of operating an internal combustion engine including at least one cylinder having at least one intake valve and one exhaust valve, comprising:

during an engine start:

compressing gasses in the cylinder during at least two compression strokes to increase temperature of the gasses, adjusting valve timing during said compressing to adjust a compression temperature of the gasses;

injecting fuel directly into the cylinder; and achieving auto-ignition within the cylinder of the at least twice compressed gasses to start the engine.

28. The method of claim 27 wherein said gasses include inducted air, and said valve timing is adjusted to progressively increase temperature and control timing of said auto-ignition of the directly injected fuel.

* * * * *